United States Patent [19]

Kosmahl

[11] Patent Number: 4,564,787

[45] Date of Patent: Jan. 14, 1986

[54] LINEARIZED TRAVELING WAVE AMPLIFIER WITH HARD LIMITER CHARACTERISTICS

[75] Inventor: Henry G. Kosmahl, Olmsted Falls, Ohio

[73] Assignee: The United States of America as respresented by the Administrator of the National Aeronautics and Space Administration, Washington, D.C.

[21] Appl. No.: 714,051

[22] Filed: Mar. 20, 1985

Related U.S. Application Data

[63] Continuation-in-part of Ser. No. 492,522, May 9, 1983, abandoned.

[51] Int. Cl.[4] ..... H01J 25/34

[52] U.S. Cl. ..... 315/3.6; 315/3.5; 315/39.3; 330/43

[58] Field of Search ..... 315/3.5, 3.6, 39.3; 330/43

[56] References Cited

U.S. PATENT DOCUMENTS

| | | | |
|---|---|---|---|
| 3,614,517 | 10/1971 | Dionne | 315/3.6 |
| 3,678,326 | 7/1982 | Heynisch | 315/3.6 |
| 3,761,760 | 9/1973 | Harper et al. | 315/3.6 |
| 3,809,949 | 5/1974 | Scott | 315/3.5 |
| 3,846,664 | 11/1974 | King et al. | 315/3.6 |
| 4,107,572 | 8/1978 | Yuasa et al. | 315/3.6 |
| 4,315,194 | 2/1982 | Connolly | 315/3.6 |
| 4,378,512 | 3/1983 | Tsutaki | 315/3.6 |

*Primary Examiner*—Saxfield Chatmon
*Attorney, Agent, or Firm*—James A. Mackin; John R. Manning

[57] ABSTRACT

The object of the invention is to provide a traveling wave tube with increased linearity to avoid intermodulation of signals being amplified. In a traveling wave tube 10, as shown in FIG. 1, the slow wave structure is a helix (18) including a sever (21). A dynamic velocity taper is provided by gradually reducing the spacing (26) between the repeating elements of the slow wave structure which are the windings of helix (18). The reduction takes place between Zo indicated by line 23 and $Z_s$ which coincides with the output point of helix (18) as indicated by the line (22). The spacing (26) begins to decrease at $Z_o$ and is decreased by up to about 5% at $Z_s$. The spacing (26) between the repeating elements of the slow wave structure is ideally at an exponential rate because the curve (27), as shown in FIG. 3, increases from $Z_o$ to Zs the point of maximum efficiency and power, at an exponential rate. FIG. 3 shows a coupled cavity traveling wave tube having cavities 32 through 37. The axial length of cavities (35) through (37) is gradually reduced between $Z_o$ to $Z_s$. To this end, the spacing between apertured discs 38 is gradually reduced between $Z_o$ and $Z_s$ from 0.1% to 5% at an exponential rate. In FIG. 4, curve 28 represents output power (or efficiency) versus input power for a commercial tube. Curve 31 represents the same parameters for a tube embodying the invention and shows the great linearity achieved by the dynamic velocity taper.

7 Claims, 5 Drawing Figures

LINEARIZED TRAVELING WAVE AMPLIFIER WITH HARD LIMITER CHARACTERISTICS

ORIGIN OF THE INVENTION

This invention was made by an employee of the United States Government and may be manufactured or used by or for governmental purposes without the payment of any royalties thereon or therefor.

This application is a continuation of application Ser. No. 492,522 filed May 9, 1983, abandoned.

TECHNICAL FIELD

This invention relates to radiofrequency amplifying tubes and, more particularly, to traveling wave amplifying tubes wherein a traveling electromagnetic wave and an electron beam interact to effect amplification of a radiofrequency signal.

Because of the presently increasing demand for satellite-to-earth communications, it is clear that the capacity limits of the frequency bands of presently-used satellites will be exceeded within a few years. Thus, it is desirable to be able to transmit many different signals by various techniques such as frequency modulation or pulse width modulation either of which may be multiplexed.

To avoid intermodulation between the signals in a traveling wave amplifier tube, it is essential that the tube be operated only in its linear region. Consequently, it has been necessary to operate traveling wave tubes under a back-off condition wherein the output power with relation to the input power is much less than maximum in order to stay in a linear region of operation. Accordingly, it would be advantageous to have a traveling wave tube which has a greatly increased range of linear operation.

PRIOR ART

U.S. Pat. No. 3,668,544 to Lien discloses a slow wave tube wherein the signal to be amplified and a harmonic thereof are applied concurrently over at least a portion of the slow wave circuit to increase the RF conversion efficiency of the tube.

U.S. Pat. No. 3,614,517 to Dionne introduces an intermediate phase velocity profile at a relatively low level of electron beam energy extraction and well before tube saturation to increase efficiency of the tube.

U.S. Pat. No. 3,809,949 to Scott discloses a vane loaded helix derived slow wave circuit wherein the degree of penetration of the vanes into the slow wave circuit is increased at the output end of the tube for introducing a frequency dependent velocity taper to increase efficiency of the tube.

U.S. Pat. No. 3,940,654 to Winslow employs a helical structure that is loaded by placing longitudinal vanes or conductors around the helix adjacent its output end. The conductors are arranged such that the spacing from the conductor to the slow wave circuit decreases in a direction toward the collector. The Winslow structure increases the efficiency and the band width of a traveling wave tube but does not improve linearity.

U.S. Pat. No. 3,903,449 to Scott anisotropically loads the helix of a traveling wave tube with vanes or sectors comprised of berrylia or boron nitride rods. These loading elements increase the operating band width over which the relatively high gain and efficiency are obtainable.

U.S. Pat. No. 4,107,527 to Yuasa et al discloses a traveling wave tube having a slow wave circuit consisting of a constant phase velocity section and a phase velocity tapering section serially arranged between an attenuator and the output of the slow wave circuit. A particular ratio between the length of the constant phase velocity section and the phase velocity tapering section is prescribed for the purpose of improving the tube efficiency.

U.S. Pat. No. 3,972,005 to Nevins, Jr. et al discloses a traveling wave tube having a conductive circuit loading structure surrounding a helix slow wave circuit and extending for at least half the length of the helix and preferably for its entire length. The conductive circuit loading structure comprises a plurality of conductors disposed around the helix and arranged to conduct current associated with the radial frequency fields substantially only in the radial or axial direction of the helix and not in the circumferential direction. Such an arrangement results in an ultra wide band, high efficiency traveling wave tube.

U.S. Pat. No. 3,758,811 to Wong is concerned with the reduction of intermodulation products, which reduction may be achieved by increased linearity of operation of a traveling wave tube. The slow wave structure of Wong's traveling wave tube comprises a helix divided into three sections. The first section is a slow velocity and attenuator circuit; the second section is a positive velocity step producer and the third section is a fast velocity circuit section having less pitch than the first section. Wong applies a positive velocity taper abruptly to the traveling wave.

DISCLOSURE OF THE INVENTION

In accordance with the present invention, a dynamic velocity taper is provided for a traveling wave tube. The taper begins at a point on the tube slow wave structure at which efficiency begins to become greater than about 0.1% and extends in a downstream direction toward a collector electrode to the point at which the output signal is picked off the slow wave circuit.

The dynamic velocity taper is achieved by gradually reducing the spacing between repeating elements of the slow wave structure over a prescribed distance. The reduction in spacing between the slow wave structure repeating elements starts at about 0.1% efficiency and increases to about 15% efficiency. Preferably, the reduction in spacing is at an exponential rate.

The dynamic velocity taper maintains an optimum phase relationship between the traveling wave of the slow wave structure and bunches of electrons in the electron beam. Since a computed reduction in energy of the electron bunches is used to determine the phase velocity of the slow wave circuit, it is then dynamically matched to the rate of loss of energy. The desired dynamic velocity taper may be precomputed and a slow wave structure designed accordingly, following the computer outputs.

The use of the dynamic velocity taper in accordance with the present invention provides for a traveling wave tube a characteristic that approaches that of an ideal hard limiter. Thus, the linearity of a traveling wave tube is greatly increased and the efficiency is also increased by a factor of about 1.1 to 1.5.

MODE FOR CARRYING OUT THE INVENTION

Figure 1:
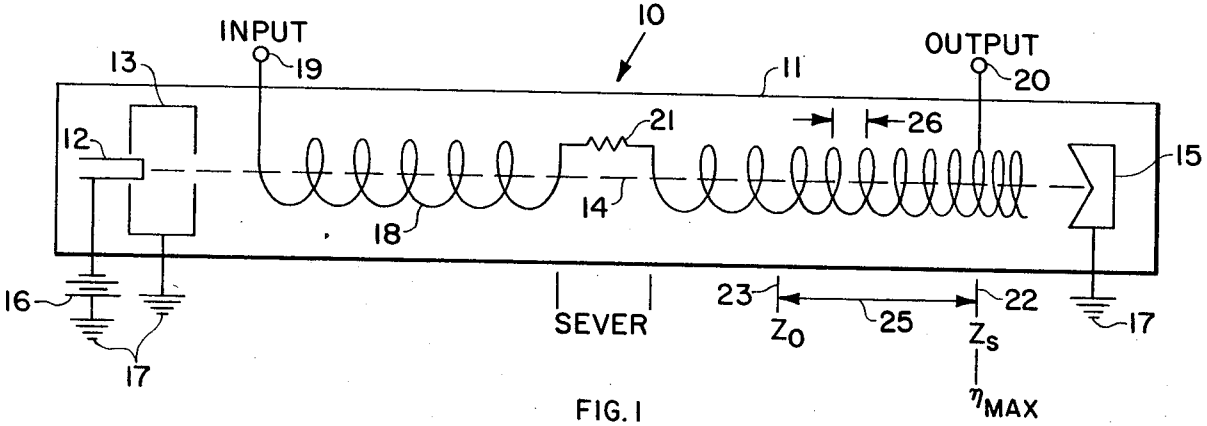
FIG. 1 is a longitudinal schematic view of a traveling wave tube (TWT) having a helical coil, slow wave structure (SWS) embodying the invention.

Referring to FIG. 1, there is shown a traveling wave tube 10 comprised of an envelope 11 with an electron emitting cathode 12 and an accelerating anode 13 at one end. Electrons emitted by cathode 12 are accelerated by the anode 13 are formed into a beam 14 which is collected at the other end of envelope 11 by a collector 15. The beam 14 is prevented from expanding due to a magnetic field from a solenoid (not shown) or permanent magnets coaxial with the envelope 11 as is common practice with traveling wave tubes having a helical slow wave structure (SWS).

Cathode 12 is maintained at a negative potential with respect to the anode 13 and the collector 15 by means of a DC source 16, the negative side of which is connected to the cathode 12, the positive side being connected to ground as at 17. The anode 13 and the collector 15 are grounded as at 17 and, accordingly, are positive with respect to cathode 12. A heater (not shown) is normally provided for cathode 12 to cause electron emission.

The slow wave structure of TWT 10 comprises a helix 18 in which the turns may be considered as repeating structural elements. A signal input terminal 19 is connected to the end of the helix closest to the cathode 12 at one end of envelope 11 while an output terminal 20 is connected to the helix 18 either at its end or at a point slightly upstream of its end which is adjacent collector 15. One or more severs 21 may be provided for the helix in a manner well-known in the prior art.

Important reference points on the helix 18 are identified by the line 23 representing the point $Z_o$ at which efficiency of the TWT 10 is approximately 0.1% and line 22 representing the point $Z_s$ at which the output signal is taken off by output terminal 20. The double ended arrow 25 indicates the axial distance between $Z_o$ and $Z_s$ over which axial spacing 26 between structural elements such as the windings of helix 18 is reduced.

Figure 3:
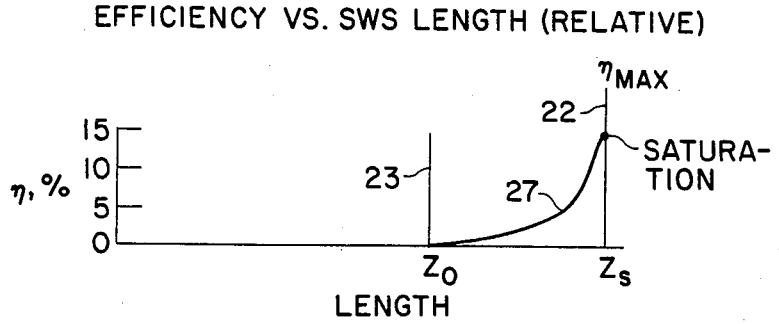
FIG. 3 is a graph showing the efficiency increase along the SWS to the point of saturation.

In FIG. 3, the curve 27 is a graph of efficiency vs. slow wave structure length. The vertical lines 22 and 23 represent the same slow wave structure axial points which they delineate in FIG. 1. As shown by the curve 27, efficiency increases exponentially from about 0.1% at $Z_o$ to about 15% at $Z_s$ which represents the output point of the helix 18 in FIG. 1. Vertical line 22 corresponds to the output point of the helix which is the point of maximum efficiency at which saturation occurs.

Figure 4:
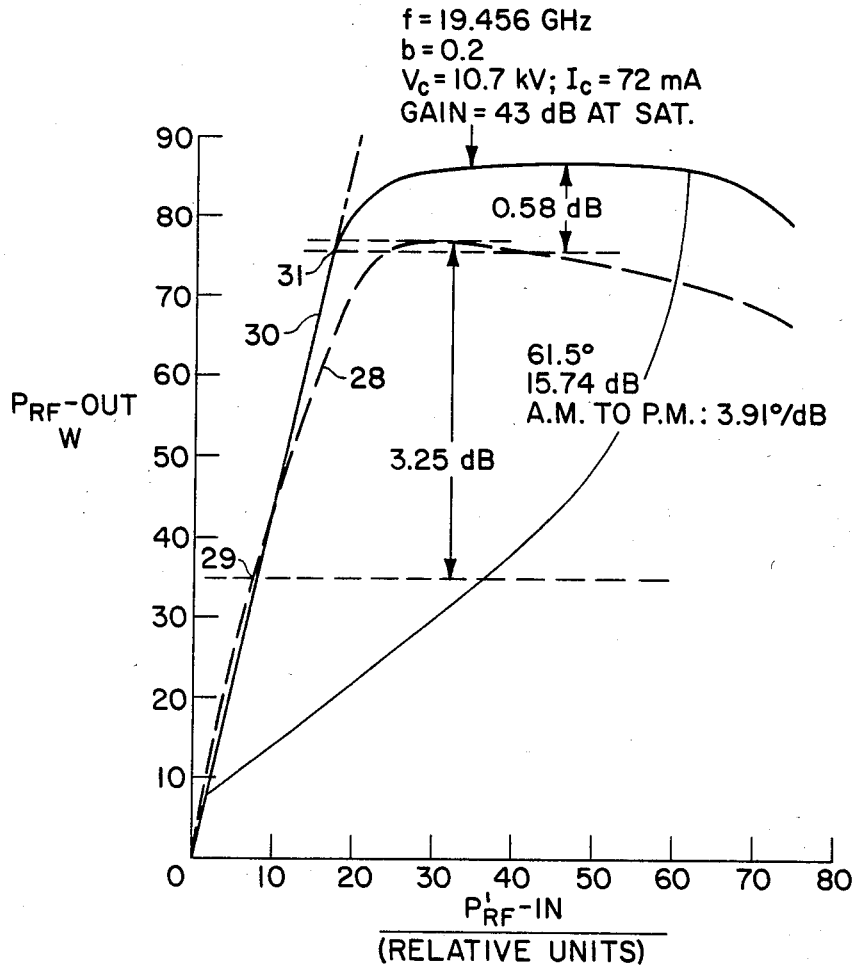
FIG. 4 is a graph of output power versus input power for a commercial TWT and for one utilizing the invention.

Referring now to FIG. 4, there is shown a curve 28 which is a graph of TWT output power or efficiency vs. input power. As discussed previously, in order to avoid intermodulation where a plurality of RF signals are being amplified, a traveling wave amplifier tube must be operated only in its linear region. The curve 28 is linear only up to approximately point 29. Thus, operation of the tube would have to be backed off to point 29, greatly reducing output efficiency and power.

Curve 30 is a graph of output efficiency or output power vs. power input for a traveling wave tube embodying the invention. This curve is linear up to approximately the point 31 and closely approximates the curve of a hard limiter. Accordingly, a TWT embodying the invention has very high linearity and higher efficiency for certain rates of reduction of repeating element spacing.

Figure 2:
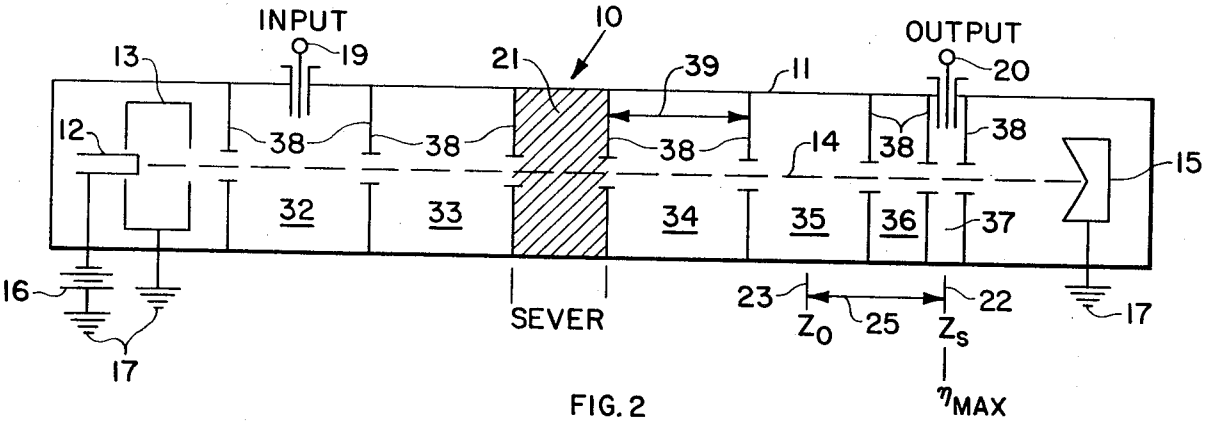
FIG. 2 is a longitudinal schematic view of a coupled cavity TWT embodying the invention.

In FIG. 2, there is shown a coupled cavity traveling wave tube 10 wherein components corresponding to those shown in FIG. 1 are identified by the same numerals. Such components include the envelope 11, cathode 12, anode 13, electron beam 14, collector 15, DC source 16 and the common grounds 17. Additional parts of the TWT of FIG. 2 corresponding to parts in FIG. 1 include input terminal 19, output terminal 20 and a sever 21.

In the tube of FIG. 2, cavities 32 through 37 are formed by a plurality of axially spaced discs 38. The discs 38 have central apertures to allow for passage of the electron beam 14 and are perpendicular to the long axis of the envelope 11.

It will be seen that the axial length of cavity 37 is smaller than that of 36 which, in turn, is smaller than that of 35, with 35 having a smaller axial length than cavity 34. Cavities 32, 33 and 34 all have the same axial length which is determined by the spacing between the discs 38 as indicated by the double ended arrow 39.

In a downstream direction, that is, going toward collector 15, the axial spacing of discs 38 decreases after point $Z_o$ to form the cavities 35–37. As in the case of the TWT shown in FIG. 1, the spacing between the discs 38, the repeating elements, is greatly exaggerated for purposes of illustration. In an actual coupled cavity tube, there would be many more cavities and the reduction in spacing between the repeating elements 38 would be much less drastic and would be at a gradual rate of reduction between 0.1% efficiency and 15% efficiency between $Z_o$ and $Z_s$, the decrease being preferably at an exponential rate to obtain maximum linearity.

Figure 5:
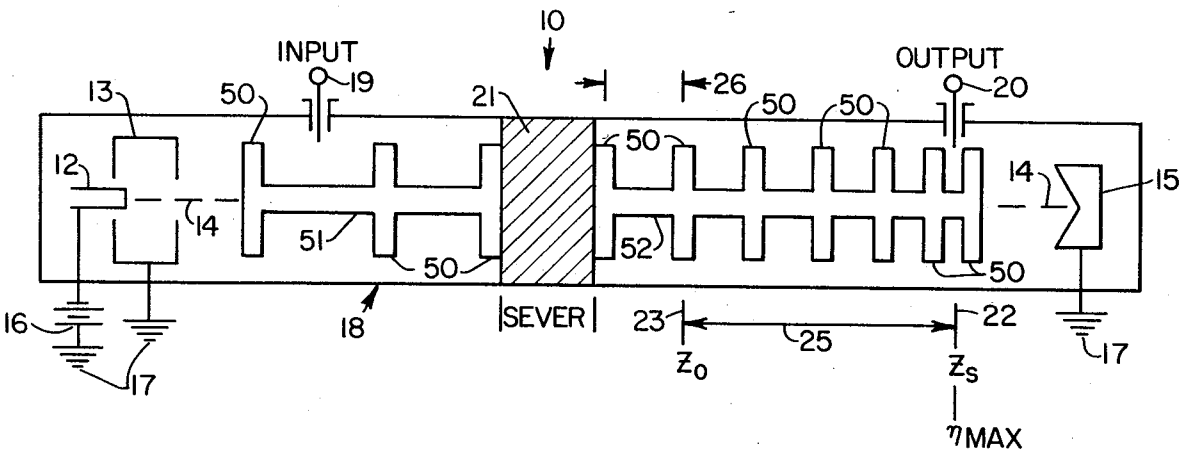
FIG. 5 is a longitudinal schematic view of a TWT wherein the SWS embodying the invention is a ring-bar circuit.

In FIG. 5 there is shown a TWT 10 having a ring bar type SWS. The same numerals are used to identify corresponding parts and items in FIGS. 1 and 5 and include envelope 11, cathode 12, anode 13, electron beam 14, collector 15, DC source 16, grounds 17, terminals 19,20 and sever 21. The ring bar SWS is comprised of rings 50 the rings being connected by bars 51 upstream of sever 21 and by bars 52 downstream of sever 21. From the point $Z_o$ on the SWS indicated by line 23 to the point $Z_s$ indicated by line 22 the spacing between rings 50 gradually decreases in a downstream direction preferrably at an exponential rate.

The equations below establish the parameters for the determination of dynamic velocity taper.

$$b(Z)=b_o[1+\alpha\eta(Z)] \quad (1)$$

$$\eta(Z)=e^{\Gamma(Z-Z_o)}-1. \quad (2)$$

$$b_o=\frac{u-V_p}{C\,V_p} \quad (3)$$

$$b(Z)=\frac{u-V_p(Z)}{C\,V_p(Z)} \quad (4)$$

-continued $$V_p(Z) = \frac{u}{1 + Cb(Z)} \quad (5)$$

$\alpha$=constant to be determined, $0<\alpha<50$ $b_o$=Pierce's velocity parameter (constant)

b(Z)=modified, dynamic velocity parameter

C=Pierce's gain (efficiency parameter)

u=dc electron velocity in the TWT $V_p$=initial, constant phase velocity of the slow wave circuit $V_p(Z)$=modified, dynamic phase velocity of the slow wave circuit.

In the physical implementation of the invention, the dynamic velocity taper should be placed downstream of the last sever, where the local efficiency on the circuit $\eta(Z)$ just begins to become larger than zero, $\eta(Z) \geqq 0.1\% \geqq 0.001$. In this region which begins at $Z=Z_o$ and ends at $Z=Z_s$ (saturation) the efficiency $\eta(Z)$ is approximated by the expression (2) above It may be seen that since $\eta(Z_o)=0$ and because $\eta(Z_s)=\eta_s$ is the efficiency at saturation of a conventional, untapered TWT, the determination of $\Gamma$ may be made.

Thus, since $$e^{\Gamma(Z_s-Z_o)}-1=\eta_s,$$

$$e^{\Gamma(Z_s-Z_o)}=1+\eta_s$$

and $$\Gamma(Z_s-Z_o)=ln(1+\eta_s)$$

which yields $$\Gamma = \frac{\ln(1+\eta_s)}{Z_s - Z_o} \approx \frac{\eta}{Z_s - Z_o}$$

Thus, all the parameters for the determination of the dynamic velocity taper are known from equations (4) and (5). The choice of the parameter $\alpha$ is made such as to produce the highest degree of linearity with an acceptable degree of AM to PM conversion, e.g.: less than 5° per decibel. Note that the velocity taper must not be placed in the small signal region.

As discussed above, the efficiency of a TWT embodying the instant invention increases from about 0.1% at $Z_o$ on the SWS to about 15% at $Z_s$. The spacing between all repeating elements of the SWS, i.e. the coils of helix 18 in FIG. 1, the walls 38 of FIG. 2 and the rings 50 of FIG. 5, is constant from the sever 21 to $Z_o$. Therefore the reduction in spacing is zero for that portion of the SWS upstream of sever 21.

The reduction in spacing begins at point $Z_o$ and increases to between 5% and 15% at $Z_s$ with 5% providing greatest linearity and 15% providing most efficiency. Thus, the spacing between repeating elements of the SWS is reduced in a downstream direction from 0% at $Z_o$ to where the efficiency is about 0.1% to between 5% and 15% at $Z_s$ where the efficiency is about 15%.

While the invention has been described with respect to amplifying tubes embodying coupled cavities or helixes, it is applicable as well to other traveling wave tubes having slow wave structures comprised of repeating elements. Such tubes include those with ladder or ring-bar circuits for example.

It will be understood that changes and modifications may be made to the above described invention without departing from its spirit and scope as set forth in the claims appended hereto.

I claim:

1. In a traveling wave tube (TWT) having a long axis, an output point Zs, an input point, a slow wave structure (SWS), comprised of repeating structural elements disposed along said long axis at least from said input to said output and including at least one sever between said input and said output, the improvement comprising a gradual reduction of the axial spacing of said repeating structural elements at an exponential rate from a point $Z_o$ on the SWS at which efficiency is about 0.1% to said output point $Z_s$ whereby the linearity and efficiency of the TWT are greatly increased by the dynamic velocity taper resulting from the gradual decrease of axial spacing of said repeating structural elements.

2. The TWT of claim 1 wherein the velocity taper increases from 0 to between 5% and 15% from $Z_o$ to $Z_s$ on the SWS.

3. The TWT of claim 1 wherein the SWS is a helix.

4. The TWT of claim 3 wherein a reduction of pitch of the helix increases from 0 to between 5.0% and 15% from $Z_o$ to $Z_s$ on the SWS.

5. The TWT of claim 1 wherein the slow wave structure is a ring bar structure and wherein the spacing between the rings is gradually reduced between $Z_o$ and $Z_s$ such that there is a velocity taper of from 0 to between about 5.0% and 15% between $Z_s$ and $Z_o$ on the SWS.

6. The TWT of claim 1 comprised of coupled cavities formed by apertured discs disposed in said TWT perpendicular to its long axis and wherein the axial spacing between the discs is gradually reduced between the $Z_o$ and $Z_s$ points of the TWT.

7. The TWT of claim 6 wherein the reduction of the spacing is increased from about 0 to between between about 5.0% and 15% between $Z_o$ and $Z_s$ on the SWS.

* * * * *